US007225927B2

(12) United States Patent
Sweeney

(10) Patent No.: US 7,225,927 B2
(45) Date of Patent: Jun. 5, 2007

(54) CUP HOLDER HAVING FRUSTO-CONICAL CAVITIES

(75) Inventor: Richard C. Sweeney, Falmouth, ME (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 10/621,817

(22) Filed: Jul. 17, 2003

(65) Prior Publication Data

US 2005/0012009 A1 Jan. 20, 2005

(51) Int. Cl.
*B65D 1/36* (2006.01)

(52) U.S. Cl. ..... 206/564; 248/311.2; 220/23.8

(58) Field of Classification Search ..... 248/311.2; 229/406, 407; 206/433, 564; 220/507
See application file for complete search history.

(56) References Cited

U.S. PATENT DOCUMENTS

| | | | | |
|---|---|---|---|---|
| D52,278 | S | 8/1918 | Kraus | |
| 1,520,402 | A | 12/1924 | Clemans | |
| 1,541,672 | A | 6/1925 | Tulay | |
| 1,848,066 | A | 3/1932 | Shepard et al. | |
| D91,229 | S | 12/1933 | Pyle | |
| 2,314,935 | A | 3/1943 | Gutterman | 65/53 |
| D145,718 | S | 10/1946 | Geddes | D44/10 |
| D153,209 | S | 3/1949 | Reamer | 58/16 |
| D157,540 | S | 2/1950 | Shepard | D58/13 |
| D157,759 | S | 3/1950 | Harper | D58/13 |
| D174,552 | S | 4/1955 | Hagen | 58/26 |
| 2,766,919 | A | 10/1956 | Randall | 229/2.5 |
| 2,776,772 | A | 1/1957 | Itoda | 217/26.5 |
| 2,826,346 | A | 3/1958 | Randall | 224/48 |
| 2,854,790 | A | 10/1958 | Hartung | 47/34 |
| 2,924,372 | A | 2/1960 | Kirkeby | 229/34 |
| 3,103,303 | A | 9/1963 | Lynchey | 224/48 |
| D197,358 | S | 1/1964 | De Shazor, Jr. | 58/25 |
| 3,140,035 | A | 7/1964 | Wenzel | 229/30 |
| 3,161,342 | A | 12/1964 | Wenzel | 229/28 |
| D199,991 | S | 1/1965 | McManamey | D44/10 |
| D200,249 | S | 2/1965 | Hancock | D44/10 |
| 3,220,631 | A | 11/1965 | Reifers | 229/2.5 |
| D204,071 | S | 3/1966 | Earl | D44/10 |
| D205,868 | S | 9/1966 | Immerman et al. | D58/12 |
| 3,295,737 | A | 1/1967 | Page et al. | 229/2.5 |
| 3,362,606 | A | 1/1968 | Trimble | 229/2.5 |
| 3,369,724 | A | 2/1968 | Ettlinger | 224/48 |
| 3,432,026 | A | 3/1969 | O'Leary | 206/47 |
| 3,464,618 | A | 9/1969 | Martelli et al. | 229/2.5 |

(Continued)

FOREIGN PATENT DOCUMENTS

| | | |
|---|---|---|
| FR | 1471281 | 1/1966 |

(Continued)

*Primary Examiner*—Carl D. Friedman
*Assistant Examiner*—Steven Marsh
(74) *Attorney, Agent, or Firm*—Baker Botts L.L.P.

(57) ABSTRACT

A cupholder for holding containers is provided with a number of container-holding cavities. Each of the container-holding cavities includes pairs of gripping flanges that extend inwardly toward centers of the cavities. The flanges include gripping points that extend toward each other and exert a gripping force along a bottom of an inserted container. The gripping flanges are pliable to accept a variety of inserted container sizes, but resilient enough to exert a container-holding force against containers inserted into the container-holding cavities.

20 Claims, 2 Drawing Sheets

U.S. PATENT DOCUMENTS

| | | | | |
|---|---|---|---|---|
| 3,542,280 | A | 11/1970 | Crabtree | 229/15 |
| 3,565,323 | A | 2/1971 | Katzenmeyer | 229/28 |
| 3,572,005 | A | 3/1971 | Allen et al. | 53/160 |
| 3,579,951 | A | 5/1971 | Lowery | 53/55 |
| 3,587,915 | A | 6/1971 | Theobald et al. | 220/102 |
| 3,601,277 | A | 8/1971 | Andrews et al. | 220/20 |
| 3,608,706 | A | 9/1971 | Vigue | 206/46 |
| 3,608,770 | A | 9/1971 | Naimoli | 220/16 |
| 3,622,446 | A | 11/1971 | Burnham | 162/146 |
| 3,638,849 | A | 2/1972 | Goings | 229/28 R |
| 3,647,104 | A | 3/1972 | Goings | 220/20 |
| 3,647,132 | A | 3/1972 | Crabtree | 229/3.5 |
| 3,651,976 | A | 3/1972 | Chadbourne | 220/23.4 |
| 3,656,681 | A | 4/1972 | Goings | 229/15 |
| 3,657,044 | A | 4/1972 | Singer | 156/212 |
| 3,675,811 | A | 7/1972 | Artz | 220/20 |
| 3,677,201 | A | 7/1972 | Chadbourne | 108/58 |
| 3,695,479 | A | 10/1972 | Crabtree | 217/26.5 |
| 3,749,235 | A | 7/1973 | Boursier | 206/45.31 |
| 3,765,592 | A | 10/1973 | Chadbourne | 229/2.5 |
| D229,823 | S | 1/1974 | Day | D9/183 |
| 3,845,896 | A | 11/1974 | Crabtree | 229/2.5 |
| 3,865,299 | A | 2/1975 | Crabtree | 229/2.5 |
| 3,885,727 | A | 5/1975 | Gilley | 229/2.5 |
| 3,885,728 | A | 5/1975 | Gilley | 229/2.5 |
| D235,498 | S | 6/1975 | Day | D7/99 |
| D236,575 | S | 9/1975 | Vigue | D7/38 |
| D236,691 | S | 9/1975 | Haase | D9/185 |
| 3,904,103 | A | 9/1975 | Chadbourne | 229/2.5 |
| 3,915,371 | A | 10/1975 | Crabtree | 229/15 |
| D238,249 | S | 12/1975 | Erickson | D9/99 |
| 3,942,671 | A | 3/1976 | Florian | 220/23.8 |
| 3,944,109 | A | 3/1976 | Holz | 220/20 |
| 3,955,672 | A | 5/1976 | Brundage | 206/72 |
| 3,963,172 | A | 6/1976 | Holzwarth et al. | 229/44 |
| 3,986,655 | A | 10/1976 | Rynning | 229/2.5 |
| D242,325 | S | 11/1976 | Olsen | D9/99 |
| 3,997,057 | A | 12/1976 | Craig | 206/507 |
| 4,053,099 | A | 10/1977 | Lock | 229/28 |
| 4,057,169 | A | 11/1977 | Payne | 220/306 |
| D247,507 | S | 3/1978 | Ramacher, Jr. | D23/105 |
| 4,088,259 | A | 5/1978 | Sutton | 229/2.5 |
| D248,371 | S | 7/1978 | Davis | D9/179 |
| 4,098,403 | A | 7/1978 | Davis | 206/519 |
| 4,101,049 | A | 7/1978 | Wallace et al. | 229/2.5 |
| 4,108,321 | A | 8/1978 | Lowery | 214/8.5 |
| D249,620 | S | 9/1978 | Vigue | D7/38 |
| D249,622 | S | 9/1978 | Vigue | D7/3 |
| D249,638 | S | 9/1978 | Chadbourne | D9/189 |
| D249,769 | S | 10/1978 | Vigue | D7/38 |
| D250,091 | S | 10/1978 | Jewell | D9/179 |
| D250,243 | S | 11/1978 | Vigue | D7/38 |
| 4,143,805 | A | 3/1979 | Sutton | 229/44 |
| 4,155,502 | A | 5/1979 | Forte | 229/28 |
| 4,157,755 | A | 6/1979 | Gough | 206/193 |
| D253,456 | S | 11/1979 | Payne | D9/182 |
| D253,506 | S | 11/1979 | Vigue | D6/6 |
| D253,561 | S | 12/1979 | Vigue | D7/71 |
| 4,194,781 | A | 3/1980 | Lowery | 294/61 |
| D254,956 | S | 5/1980 | Gilley | D9/3 |
| 4,208,006 | A | 6/1980 | Bixler et al. | 229/2.5 |
| D256,435 | S | 8/1980 | Payne | D9/182 |
| 4,218,008 | A | 8/1980 | Veilleux | 229/2.5 |
| 4,219,144 | A | 8/1980 | Hagelberg | 229/2.5 R |
| D257,555 | S | 11/1980 | Ikushima et al. | D9/425 |
| 4,280,648 | A | 7/1981 | Boursier | 229/2.5 |
| 4,288,013 | A | 9/1981 | Napier | 294/87.2 |
| 4,337,116 | A | 6/1982 | Foster et al. | 162/158 |
| D268,645 | S | 4/1983 | Phillips et al. | D9/341 |
| 4,381,847 | A | 5/1983 | Bessett et al. | 229/2.5 |
| 4,427,730 | A | 1/1984 | Robbins et al. | 428/156 |
| D274,110 | S | 6/1984 | Vigue | D7/71 |
| 4,456,164 | A | 6/1984 | Foster et al. | 229/43 |
| 4,485,610 | A | 12/1984 | Gilley et al. | 53/452 |
| D279,259 | S | 6/1985 | Bixler et al. | D9/341 |
| D283,676 | S | 5/1986 | Kochling | D9/344 |
| 4,607,758 | A | 8/1986 | Stevens | 220/23.83 |
| 4,610,349 | A | 9/1986 | Schwartz et al. | 206/175 |
| D289,010 | S | 3/1987 | Vigue | D9/345 |
| 4,653,685 | A | 3/1987 | Leary et al. | 229/2.5 |
| D290,580 | S | 6/1987 | Vigue | D9/345 |
| D292,483 | S | 10/1987 | Commisso et al. | D9/341 |
| D293,377 | S | 12/1987 | Chadbourne | D24/56 |
| 4,720,321 | A | 1/1988 | Smith | 156/549 |
| D296,192 | S | 6/1988 | Ramirez | D9/424 |
| 4,757,937 | A | 7/1988 | Maio et al. | 229/41 |
| 4,823,959 | A | 4/1989 | Bixler | 206/562 |
| D301,820 | S | 6/1989 | Wasserman | D7/38 |
| D302,114 | S | 7/1989 | Ashby | D9/345 |
| D302,122 | S | 7/1989 | Ashby | D7/300 |
| 4,852,738 | A | 8/1989 | Craig et al. | 206/369 |
| D304,678 | S | 11/1989 | Vigue | D9/341 |
| D305,192 | S | 12/1989 | van Erkel | D7/1 |
| D305,713 | S | 1/1990 | Seifried | D7/71 |
| D309,258 | S | 7/1990 | Vigue | D9/341 |
| D310,027 | S | 8/1990 | Bixler | D9/424 |
| 4,966,297 | A | 10/1990 | Doty | 220/23.83 |
| D311,847 | S | 11/1990 | Meisner | D7/325 |
| 4,967,908 | A | 11/1990 | Kessler | 206/518 |
| 4,989,742 | A | 2/1991 | Powell | 220/23.4 |
| 5,035,327 | A | 7/1991 | Denzin et al. | 206/518 |
| 5,036,980 | A | 8/1991 | Vigue et al. | 206/515 |
| D319,579 | S | 9/1991 | Vigue | D9/341 |
| 5,069,335 | A | 12/1991 | Beales | 206/144 |
| 5,071,008 | A | 12/1991 | Hradisky | 206/507 |
| 5,096,065 | A | 3/1992 | Vigue | 206/564 |
| D327,841 | S | 7/1992 | Letourneau | D9/348 |
| 5,127,526 | A | 7/1992 | Vigue | 206/587 |
| 5,152,398 | A | 10/1992 | Forestal et al. | 206/561 |
| D331,008 | S | 11/1992 | Vigue | D7/554 |
| D332,743 | S | 1/1993 | Vigue | D9/341 |
| 5,205,474 | A | 4/1993 | Stuart et al. | 229/1.5 |
| 5,221,001 | A | 6/1993 | Eisman | 206/144 |
| 5,244,094 | A | 9/1993 | Graff, Jr. et al. | 206/564 |
| D339,983 | S | 10/1993 | Breton et al. | D9/347 |
| 5,301,871 | A | 4/1994 | Gross et al. | 229/1.5 |
| 5,316,173 | A | 5/1994 | Emery | 220/556 |
| 5,323,926 | A | 6/1994 | Pomroy et al. | 220/526 |
| 5,335,787 | A | 8/1994 | Finchum et al. | 206/564 |
| 5,335,814 | A | 8/1994 | Hepp | 220/509 |
| 5,421,459 | A | 6/1995 | Mazzotti | 206/549 |
| 5,423,478 | A | 6/1995 | Roosa | 229/117 |
| 5,449,071 | A | 9/1995 | Levy | 206/569 |
| 5,464,150 | A | 11/1995 | Porres Sanchez et al. | 229/120.38 |
| 5,474,172 | A | 12/1995 | Zavatone et al. | 206/158 |
| 5,497,885 | A | 3/1996 | Sussman | 206/563 |
| 5,518,110 | A | 5/1996 | Harrelson | 206/139 |
| 5,526,925 | A | 6/1996 | Bernstein | 206/162 |
| 5,564,583 | A | 10/1996 | Kelley et al. | 220/23.83 |
| 5,566,852 | A | 10/1996 | Emery | 220/556 |
| 5,573,111 | A | 11/1996 | Gordon et al. | 206/151 |
| 5,609,379 | A | 3/1997 | Harrelson | 294/87.2 |
| 5,624,024 | A | 4/1997 | Miess | 206/172 |
| D384,275 | S | 9/1997 | DuBois et al. | D9/341 |
| 5,685,478 | A | 11/1997 | Tang | 229/117.14 |
| 5,713,619 | A | 2/1998 | DuBois et al. | 294/159 |
| 5,755,474 | A | 5/1998 | Slomski | 294/87.2 |
| 5,791,462 | A | 8/1998 | Whitnell | 206/144 |
| 5,857,583 | A | 1/1999 | Chantaca et al. | 220/523 |
| 5,957,276 | A | 9/1999 | Cutler et al. | 206/194 |
| 6,024,212 | A | 2/2000 | Whitnell | 206/185 |
| 6,076,876 | A | 6/2000 | Letourneau et al. | 294/143 |
| 6,089,638 | A | 7/2000 | Whitnell | 294/159 |

| | | | | |
|---|---|---|---|---|
| D436,853 | S * | 1/2001 | Sussman | D9/755 |
| D438,100 | S * | 2/2001 | Cekota | D9/755 |
| D457,425 | S | 5/2002 | Petola et al. | D9/347 |
| 6,398,056 | B1 | 6/2002 | Letourneau et al. | 220/23.8 |

FOREIGN PATENT DOCUMENTS

| | | |
|---|---|---|
| GB | 2032886 A | 5/1980 |

* cited by examiner

CUP HOLDER HAVING FRUSTO-CONICAL CAVITIES

FIELD OF THE INVENTION

The present invention is directed generally to cupholders and more specifically to cupholders having frusto-conical cavities for holding cups.

BACKGROUND OF THE INVENTION

Platforms for holding cups are commonly used at sporting events, theaters, restaurants, and the like, for enabling a user to conveniently and easily hold multiple containers, such as cups or other beverage containers, with stability. It is preferable for cupholders to be easily held with one hand, and to provide a strong grip for containers placed within cavities disposed around the cupholder. It is further preferable for a cupholder to retain a significant amount of stability against tipping when the cupholder holds containers filled with beverages.

Prior cupholders have used a variety of cupholding formations within holder cavities, with varying degrees of success. There still exists a concern that cupholders for carrying multiple containers, or for carrying different types of containers, are not sufficiently sturdy and do not sufficiently grip beverage containers to provide adequate stability. There exists a need for an improved cupholder design which securely holds cups, is sturdy enough to hold a number of cups with one hand, counters tipping problems, and releases cups easily when needed. The present invention addresses this need.

SUMMARY OF THE INVENTION

According to one embodiment of the present invention, a cupholder is provided with a plurality of holding extensions adapted to grip containers inserted within cavities of the cupholder.

Cupholders according to the present invention may be provided with gripping flanges extending inwardly toward centers of cavities from holding extensions and adapted to exert a frictional force against side walls of containers inserted into the cavities.

The gripping flanges may have inner and outer facets meeting at facet interfaces that directly contact outer walls of containers inserted into the cupholder cavities. The inner facets may meet at junction regions that impart greater stability to the gripping flanges and increase holding force.

Further, gripping points may be provided at lower edges of the gripping flanges for gripping containers inserted into the cavities. The gripping flanges may provide force pushing a container inwardly such that a bottom rim provided on a container is pushed toward a raised portion of a cavity base.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings, in which.

Figure 1:
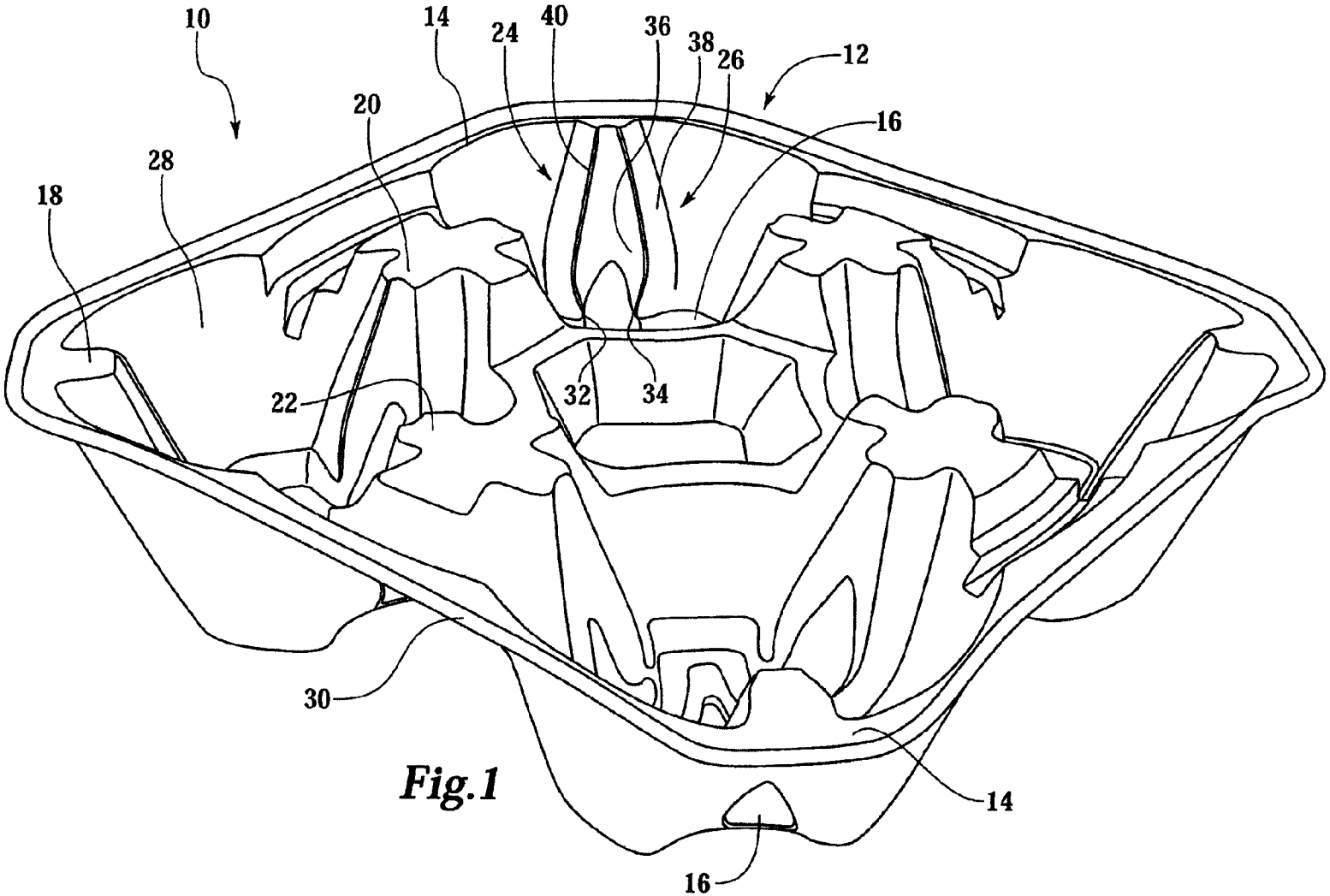
FIG. 1 is a perspective view of a cupholder.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

The present invention is directed to a cupholder designed for reliable gripping of beverage containers and exceptional sturdiness. FIG. 1 shows a cupholder 10 according to one embodiment of the present invention. The cupholder 10 of the embodiment shown in FIG. 1 has four cavities 12 adapted for holding containers such as cups, glasses, food cartons, and the like, which are generally cylindrical or tapering from an opening to a base. It is to be understood that while a four-cavity cupholder 10 is shown for illustrative purposes, the present invention applies to cupholders having more or fewer cavities as required in specific applications.

Cupholders according to the present invention are preferably formed of molded fiber. However, the principles of the present invention may be applied to cupholders formed of thermoformed plastics or foams and other construction materials as known in the packaging art.

Each cavity 12 of the cupholder 10 is formed in a generally frusto-conical shape, tapering from a widest point at a cavity mouth 14 to a narrowest point at a cavity base 16. According to one embodiment of the present invention, each cavity 12 is provided with first, second, and third holding extensions 18, 20, and 22, with each of the side wall members terminating along their sides at first and second gripping flanges 24 and 26. As will be explained in more detail below, the gripping flanges 24 and 26 are formed to extend inwardly toward a center of each cavity 12, thereby gripping cups or other containers as they are inserted into the cavities.

Between the holding extensions 18, 20, and 22, each of the cavities 12 has outwardly-curved walls 28 having a curvature corresponding to the curvature of a cone having as its base a circle having the radius of a cavity mouth 14 and as its vertex the vertex of a cone encompassing the cavity mouth 14 as its base and a cavity base 16 as a cross-sectional circle. Thus, in the orientation shown in FIG. 1, each of the cavities 12 has side wall members 18, 20, and 22 each forming a generally frusto-conical shape, with the cone extending inwardly into the page. The cupholder 10 may be provided with a strengthening downturned rim 30 to increase the sturdiness of the cupholder 10 and also to allow easy gripping of the cupholder 10 by a user.

The gripping flanges 24 and 26 serve to grip cups or other inserted containers via frictional force against the container's outer walls. Each of the gripping flanges terminates at an inwardly-extending gripping points 32 and 34. The gripping points 32 and 34 extend at acute angles from lower ends of the gripping flanges 24 and 26 and point toward each other such that a force is exerted between the gripping points and the outer walls of an inserted container, in addition to the force exerted by the gripping flanges 24 and 26 of each of the holding extensions 18, 20, and 22 toward the center of the container. The combined frictional force of the gripping points 32 and 34 and the gripping flanges 24 and 26 holds inserted containers in a stable insertion position.

Figure 2:
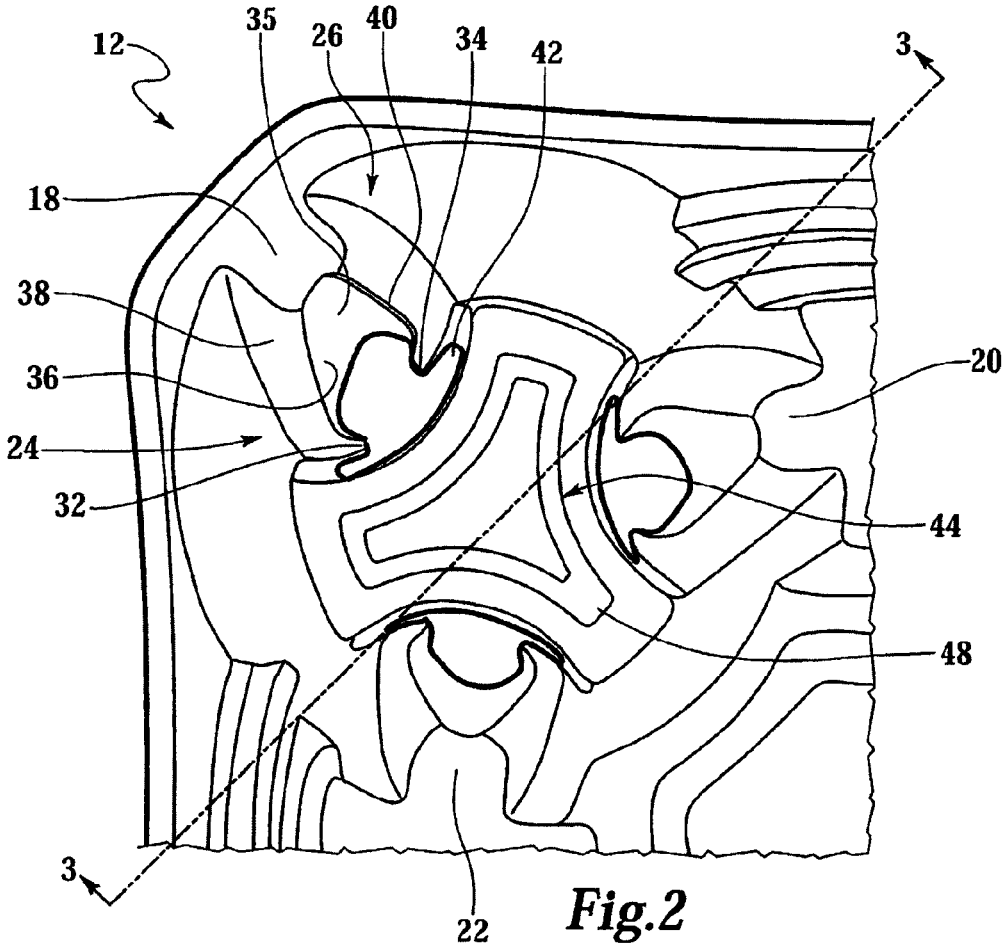
FIG. 2 is a top view of a cupholder cavity.

Turning now to FIG. 2, a top view of a cavity 12 more clearly shows the structure of the gripping flanges 24 and 26 of the holding extensions 18, 20, and 22. The gripping flanges 24 and 26 meet along a top edge at a junction region 35, and extend downwardly away from each other until they approach each other once again at the gripping points 32 and 34 located along the lower edges of each of the gripping flanges.

Each gripping flange includes two facets: a concave inner facet surface 36 and a convex outer facet surface 38. The inner facets 36 and the outer facets 38 meet at a facet interface 40 that extends along both gripping flanges 24 and 26 including the junction region 35. As illustrated in FIGS. 1 and 2, and in accordance with a preferred embodiment of the invention, the concave inner facet surface 36 is offset from the convex outer facet surface 38 to define a stepped relation at the facet interface edge 40. According to one embodiment, the junction region 35 is the meeting point of the inner facets 36 of the first and second gripping flanges 24 and 26, and it adds additional strength to the gripping flanges 24 and 26 tending to keep them from splaying excessively during use. The facet interface 40 is biased against a container inserted into the cavity 12, holding the cup in place. The tendency of the material of the cupholder 10 to maintain its original shape provides frictional force holding an inserted container in place. A bottom end of each of the holding extensions 18, 20, and 22 terminates in a cut-out area 42 that allows the gripping flanges 24 and 26 to move outwardly when a container is inserted into a cavity 12, allowing the cavity to hold different sizes of inserted containers.

The cavity base 16 is provided with a raised portion 44 that provides support when cups having bottom ridges are placed within the cavity 12. The cavity 12 of FIG. 2 is shown with three holding extensions 18, 20, and 22, though it is to be understood that cupholder cavities having more or fewer holding extensions are contemplated.

Figure 3:
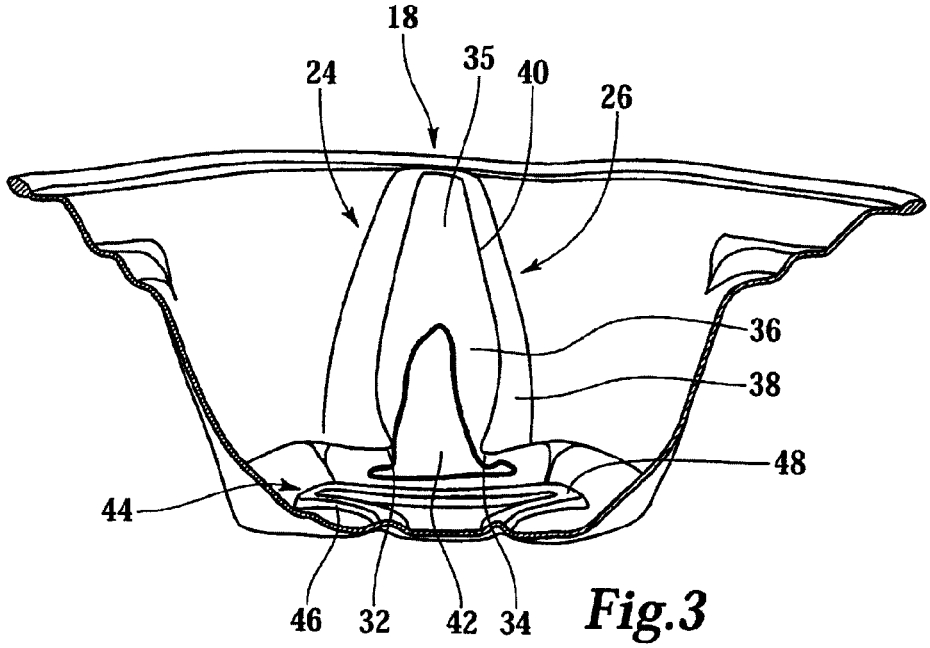
FIG. 3 is a cross-sectional view along the line 3-3 of FIG. 2.

Turning now to FIG. 3, a cross-sectional view along the line 3-3 of FIG. 2 shows the structures of a holding extension 18 more directly. The inner facets 36 and outer facets 38 of the gripping flanges 24 and 26 can be seen meeting at the facet interface 40. The first and second gripping points 32 and 34 can be seen extending inwardly from the gripping flanges 24 and 26. The junction region 35 joins the upper portions of the gripping flanges 24 and 26. According to one embodiment of the present invention, the junction regions 35 are parabolic in shape.

Cupholders according to the present invention extend the cup-contacting region between the gripping flanges 24 and 26 and a cup beyond the cup-contacting region of traditional cupholders. For example, according to some embodiments of the invention the gripping flanges 24 and 26 may contact a cup along a two-inch vertical area, while traditional cupholders have smaller cup-contacting regions of between an eighth and a quarter of an inch. The increased contact between the cup and cupholder structures increases the stability of cups held within the holder. Further, the impact of any areas where contact does not occur between the gripping flanges 24 and 26 and an inserted cup (for example, through bending or other deformation of the cupholder) is lessened because there are other areas of contact that make up for lost segments of contact.

The raised portion 44 of the cavity base includes an interior area, an exterior area and a top surface. The exterior area defines a rim gripping region 46 and the top surface defines a support region 48. The rim gripping region 46 is visible between the raised portion 44 of the cavity base 16 and the gripping flanges 24 and 26. Cups such as paper cups are commonly provided with lower rims or lips elevating a cup base from a surface on which a cup is placed. Thus, the gripping flanges 24 and 26 tend to push a cup outwardly from the page as shown in FIG. 3 so that the lower cup rim is pushed toward the rim gripping region 46 of the raised portion 44 of the cavity base 16. The support region 48 is the top surface of the raised portion 44 of the cavity base. The support region provides support for the bottom of the container or cup positioned within the cavity.

It is to be understood that cupholders according to the present invention may be made in a variety of sizes with components having a variety of different dimensions. According to one embodiment of the present invention, cupholder cavities 12 are provided with cavity mouths having a diameter of approximately 3.5 inches and cavity bases having a diameter of approximately 2.25 inches.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A cupholder comprising:

at least one cavity for holding a container, said cavity having a curved inner wall;

at least one holding extension extending inwardly toward a center of said cavity from said inner wall; and first and second gripping flanges extending inwardly from said at least one holding extension, said first and second gripping flanges having respective first and second gripping points at lower ends thereof for gripping a container inserted into said cavity, each of said gripping flanges including a concave inner facet surface and a convex outer facet surface with a facet interface edge therebetween.

2. The cupholder of claim 1 wherein said facet interface edge joins said first and second gripping flanges along an upper end of said interface edge.

3. The cupholder of claim 1 further comprising a cut-out area below said first and second gripping flanges for accepting a lower rim of a cup therein.

4. The cupholder of claim 1 wherein said concave inner facet surfaces of said first and second gripping flanges, respectively, meet at a parabolic junction region along a top end of said holding extension.

5. The cupholder of claim 1 wherein said at least one cavity has a frusto-conical shape extending from a cavity mouth at a top end of said cavity to a cavity base at a bottom end of said cavity.

6. The cupholder of claim 5 wherein said cavity base comprises a raised portion having rim gripping regions.

7. The cupholder of claim 1 being constructed of molded fiber material.

8. A cupholder comprising:

a plurality of cup-holding cavities, each of said cavities having an inner wall extending in a frusto-conical shape from a cavity mouth to a cavity base, said cavity base being narrower than said cavity mouth;

each of said cup-holding cavities having a plurality of holding extensions extending inwardly toward a center of said cavity, each of said holding extensions having first and second gripping flanges extending inwardly into said cup-holding cavities;

concave inner and convex outer facet surfaces on each said gripping flange meeting at a facet interface edge adapted to contact a container inserted into said cavity; and first and second gripping points extending inwardly toward each other at bottom ends of paired ones of said gripping flanges.

9. The cupholder of claim 8 wherein said gripping points are adapted to provide a gripping force toward each other when a container is inserted into one of said cavities.

10. The cupholder of claim 8 wherein each of said cavity bases is provided with a raised portion therein, said raised portion including a rim gripping region adapted to contact a lower rim of a cup inserted into said cavity.

11. The cupholder of claim 10 wherein said rim gripping region includes a support region adapted to contact a bottom of a cup inserted into said cavity.

12. The cupholder of claim 10 wherein said raised portion of said cavity base and said gripping flanges of each said holding extension oppose each other across a rim gripping region adapted to secure a cup within said cupholder.

13. A cupholder cavity comprising:

a cavity mouth;

a cavity base below said cavity mouth, said cavity base having a smaller diameter than said cavity mouth;

a plurality of holding extensions extending inwardly toward a center of said cavity;

a plurality of outwardly-curved walls positioned between adjacent ones of said holding extensions, said outwardly curving walls being arrayed in a frusto-conical shape between said cavity mouth and said cavity base;

first and second gripping flanges extending inwardly from each of said holding extensions, each of said first and second gripping flanges having a concave inner facet surface and a convex outer facet surface, said inner and outer facets meeting at a facet interface edge; and junction regions at upper portions of said holding extensions where said inner facet surfaces of said gripping flanges meet.

14. The cupholder cavity of claim 13 wherein each of said gripping flanges terminates at a lower edge thereof at a gripping point such that two gripping points in each of said holding extensions oppose each other toward a lower end of each of said holding extensions.

15. The cupholder cavity of claim 13 further comprising a raised portion in said cavity base, at least a portion of said raised portion of said cavity base being adapted to contact an inner lower rim of a container inserted into said cupholder.

16. The cupholder cavity of claim 13 wherein each of said holding extensions terminates at a lower end thereof at a cut-out area, said gripping flanges being moveable outwardly above said cut-out areas.

17. The cupholder cavity of claim 14 wherein said gripping points are adapted to provide a gripping force on a lower edge of a container inserted into said cavity.

18. The cupholder of claim 1, wherein the concave inner facet surface is offset from the convex outer facet surface to define a stepped relation at the facet interface edge.

19. The cupholder of claim 8, wherein the concave inner facet surface is offset from the convex outer facet surface to define a stepped relation at the facet interface edge.

20. The cupholder of claim 13, wherein the concave inner facet surface is offset from the convex outer facet surface to define a stepped relation at the facet interface edge.

* * * * *